US012011083B2

(12) United States Patent
Leng

(10) Patent No.: US 12,011,083 B2
(45) **Date of Patent: *Jun. 18, 2024**

(54) HOLLOW PANEL FURNITURE

(71) Applicant: NEW-TEC INTEGRATION (XIAMEN) CO., LTD., Xiamen (CN)

(72) Inventor: Luhao Leng, Xiamen (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/315,482

(22) Filed: May 10, 2023

(65) Prior Publication Data

US 2023/0276938 A1 Sep. 7, 2023

Related U.S. Application Data

(60) Continuation of application No. 16/946,881, filed on Jul. 9, 2020, now Pat. No. 11,684,153, which is a division of application No. 15/760,603, filed as application No. PCT/CN2016/098798 on Sep. 13, 2016, now Pat. No. 10,932,560.

(30) Foreign Application Priority Data

Sep. 16, 2015 (CN) ..... 201520717029.1

(51) Int. Cl.
*A47B 13/08* (2006.01)
*A47B 96/20* (2006.01)

(52) U.S. Cl.
CPC ..... *A47B 13/083* (2013.01); *A47B 13/08* (2013.01); *A47B 96/205* (2013.01); *A47B 2200/001* (2013.01)

(58) Field of Classification Search
CPC ..... A47B 13/08; A47B 13/083; A47B 96/205; A47B 2200/001
USPC ..... 428/172
See application file for complete search history.

(56) References Cited

U.S. PATENT DOCUMENTS 3,439,634 A * 4/1969 Bender ..... A63D 15/06 108/27
3,477,716 A * 11/1969 Bender ..... A47B 13/083 473/32
5,461,989 A * 10/1995 Grandclement ..... A47B 1/08 108/153.1
5,947,037 A * 9/1999 Hornberger ..... A47B 13/02 108/115
6,058,853 A * 5/2000 Pinch ..... A47B 3/087 108/36
10,932,560 B2 * 3/2021 Leng ..... A47B 96/205
11,684,153 B2 * 6/2023 Leng ..... A47B 13/083 428/172
2003/0200904 A1 * 10/2003 Strong ..... F16B 12/24 108/125

(Continued)

*Primary Examiner* — Travis M Figg
(74) *Attorney, Agent, or Firm* — Perkins Coie LLP

(57) ABSTRACT

A hollow table top comprises a top plate and a bottom plate stacked together. The edge of the bottom surface of the table top is disposed with a metal frame. The edge of the top plate is disposed with a downwardly extending top plate side. The metal frame is disposed with a protruding portion in the horizontal direction extending out of the top plate side. The protruding portion protects the joint of the top plate and the bottom plate. The external edge of the table top has double-layer appearance.

19 Claims, 10 Drawing Sheets

(56) References Cited

U.S. PATENT DOCUMENTS

| | | | | |
|---|---|---|---|---|
| 2003/0230219 | A1* | 12/2003 | Strong | A47B 3/087<br>108/27 |
| 2004/0187744 | A1* | 9/2004 | Wang | A47B 13/083<br>108/27 |
| 2005/0274306 | A1* | 12/2005 | Strong | A47B 13/08<br>108/115 |
| 2008/0092788 | A1* | 4/2008 | Leng | A47B 21/00<br>248/163.1 |
| 2009/0324872 | A1* | 12/2009 | Leng | B32B 3/12<br>428/73 |
| 2010/0043681 | A1* | 2/2010 | Leng | A47B 13/086<br>108/193 |
| 2010/0310811 | A1* | 12/2010 | Leng | A47C 7/16<br>428/189 |
| 2013/0025508 | A1* | 1/2013 | Leng | A47B 13/08<br>52/782.2 |
| 2016/0051049 | A1* | 2/2016 | Peery | A47B 13/083<br>108/91 |

* cited by examiner

HOLLOW PANEL FURNITURE

This Application is a continuation of U.S. application Ser. No. 16/946,881, filed Jul. 9, 2020, which is a Division of U.S. application Ser. No. 15/760,603 filed Aug. 28, 2018, now U.S. Pat. No. 10,932,560, which is a 371 National Stage Entry of PCT/CN2016/098798 filed Sep. 13, 2016, claiming priority to Chinese Application No. 201520717029 filed Sep. 16, 2015. These Applications are incorporated herein by reference.

BACKGROUND OF THE INVENTION

A known plastic table top has a single thick plate or two layers of thin plates. These table tops are blow molding types and vacuum forming types. These hollow table ops have a top plate and a bottom plate stacked together. A metal frame is disposed at the inner side of the periphery of the stacked top plate and the bottom plate. Existing vacuum forming table tops need vertical flanges at the inner side of the periphery of the top and bottom plate to cover the metal frame. The joint of the top plate and the bottom plate is exposed. In use fingers or clothes may be caught or clamped by the vertical flanges, causing injury or damaging clothes or the vertical flanges. This kind of embedded metal frame only acts to increase strength and connect the support elements but it cannot protect the connecting points of the top plate and the bottom plate.

SUMMARY OF THE INVENTION

A frame structure of a table top with stable structure and high security overcomes the disadvantages of the related art. A hollow table top has a top plate and a bottom plate, the bottom plate is disposed with projections or concave features. The edge of the bottom surface of the table top is disposed with a metal frame, the edge of the top plate extends downwardly. The metal frame is disposed with a protruding portion in the horizontal direction extending out of the top plate side.

In another preferred embodiment, the protruding portion of the metal frame is a crimping bending upwardly and covers the bottom portion of top plate side.

In another preferred embodiment, the protruding portion of the metal frame is closed to the bottom portion of the top plate side. In another preferred embodiment, the bottom portion of the top plate side bends towards the metal frame. The side surface of the hollow table top is substantially a plane.

In another preferred embodiment, the edge of the bottom plate is disposed with a downwardly extending bottom plate side. The crimping covers the bottom portion of the bottom plate side. In another preferred embodiment, the bottom portion of the bottom plate side bends towards the metal frame.

In another preferred embodiment, the bottom portion of the bottom plate is disposed with a downwardly extending fixing portion. The fixing portion is disposed at the side of the top plate side opposite to the metal frame. A screw laterally passes through the fixing portion to lock to the metal frame.

Compared to the existing known technology, advantages are:

1. The external side of the metal frame extends out of the top plate side, and covers the bottom portion of the top plate side or abuts against the bottom portion of the top plate side. When being used, the bottom portion of the top plate is not folded up, improving the integration of the table top. Fingers or clothes are not clamped by the vertical flange. At the same time, the crimping covers the top plate side.

2. The metal frame is detachably locked to the bottom plate, the structure is simple and more stable.

DETAILED DESCRIPTION OF THE EMBODIMENTS

The First Embodiment

Figure 1:
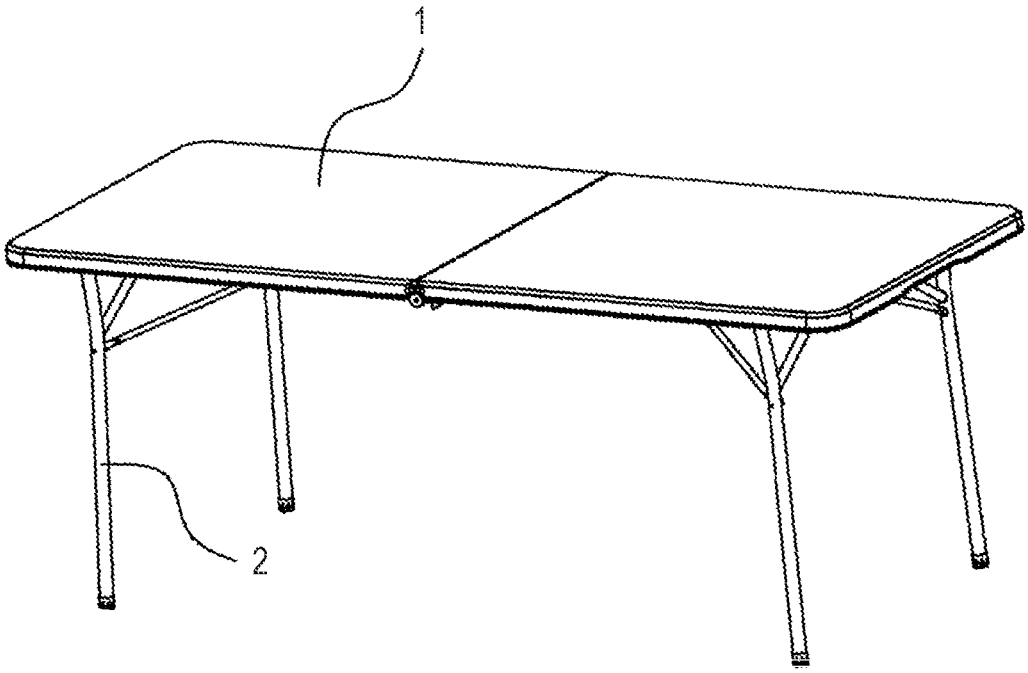
FIG. 1 illustrates a schematic diagram of a table.
Figure 2:
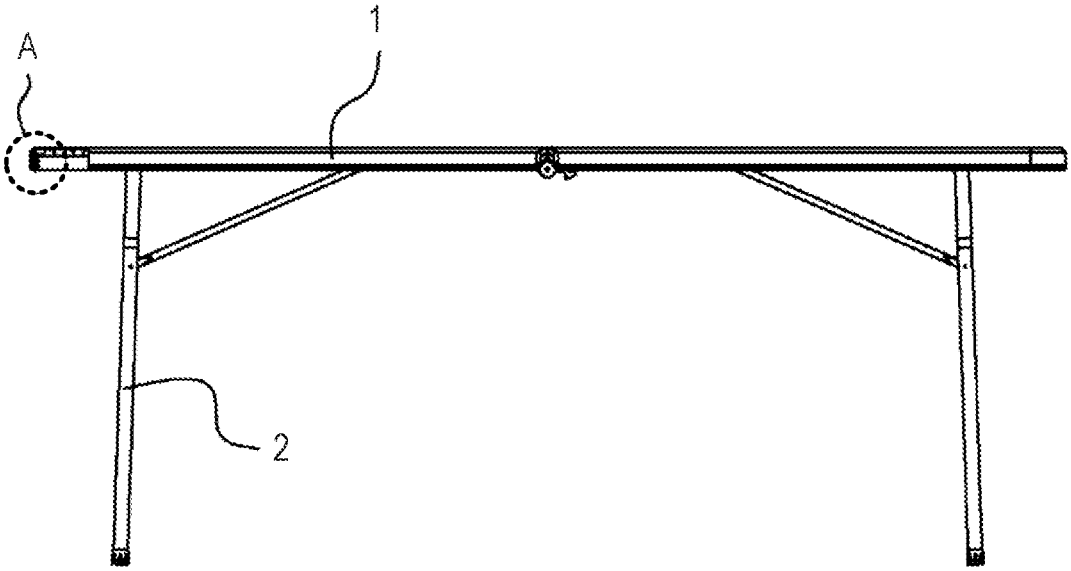
FIG. 2 illustrates a front view of the table of FIG. 1.
Figure 3:
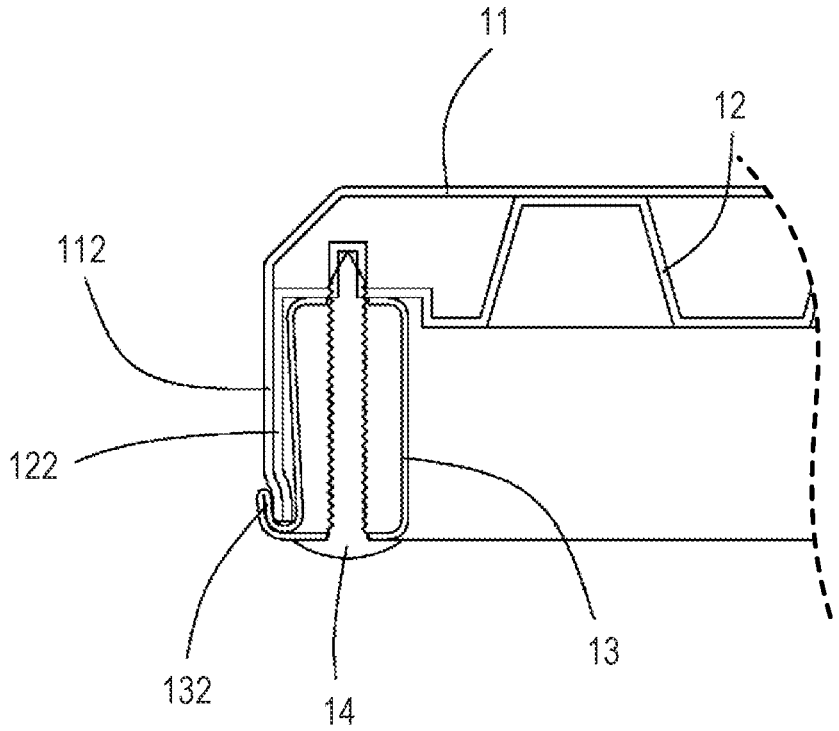
FIG. 3 illustrates an enlargement diagram of area A of FIG. 2.

Referring to FIG. 1, FIG. 2 and FIG. 3, the table comprises a table top 1 and table legs 2. The table legs 2 are foldable and connected to the bottom of the table top 1. The table top 1 comprises a top plate 11 and a bottom plate 12 being stackable together. The bottom plate 12 has concave features or projections 121. The edge of the bottom surface of the top plate 1 is disposed with a metal frame 13. The bottom plate 12 is supported on the metal frame 13. The metal frame 13 is detachably locked to the bottom plate 12. A screw 14 passes through the metal frame 13 to lock to the bottom plate 12 from end up.

The edge of the top plate 11 is disposed with a downwardly extending top plate side 112. The bottom portion of the top plate side 112 bends towards the metal frame 13. The edge of the bottom plate 12 is disposed with a downwardly extending bottom plate side 12. The bottom portion of the bottom plate side 122 bends towards the metal frame 13. The top plate side 112 and the bottom plate side 122 are contacted together. The metal frame 13 has a protruding portion, which, in this embodiment is a crimping 132 bending upwardly from the bottom portion of the top plate side 112. The crimping 132 covers the bottom portion of the top plate side 112 and the bottom plate side 122.

The bottom portion of the top plate side and the bottom plate side bend towards the metal frame so as to make space for the crimping and keep the crimping and the external edge of the crimping vertically aligned, so the side surface is in a plane and the table top attractive.

The Second Embodiment

Figure 4:
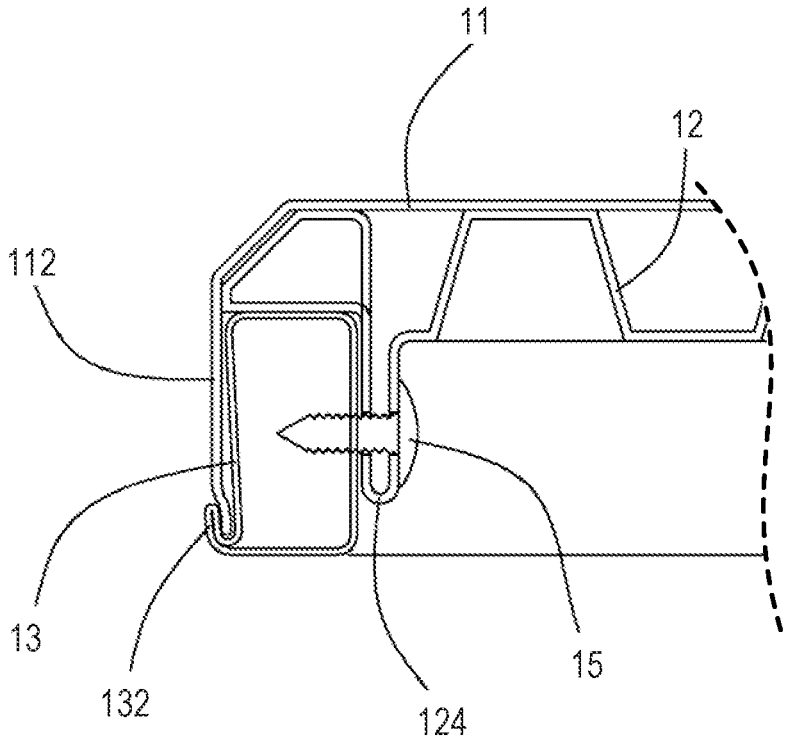
FIG. 4 illustrates a schematic diagram of a frame of another table top.

Referring to FIG. 4, the second embodiment differs from the first embodiment in that: the edge of the bottom plate 12 does not have a bottom plate side and the crimping 132 only covers the top plate side 112. The bottom portion of the bottom plate 12 extends down with a fixing portion 124, which is disposed at the side of the metal frame 13 opposite to the top plate side 112. A screw 15 laterally passes through the fixing portion 124 to lock to the metal frame 13.

The Third Embodiment

Figure 5:
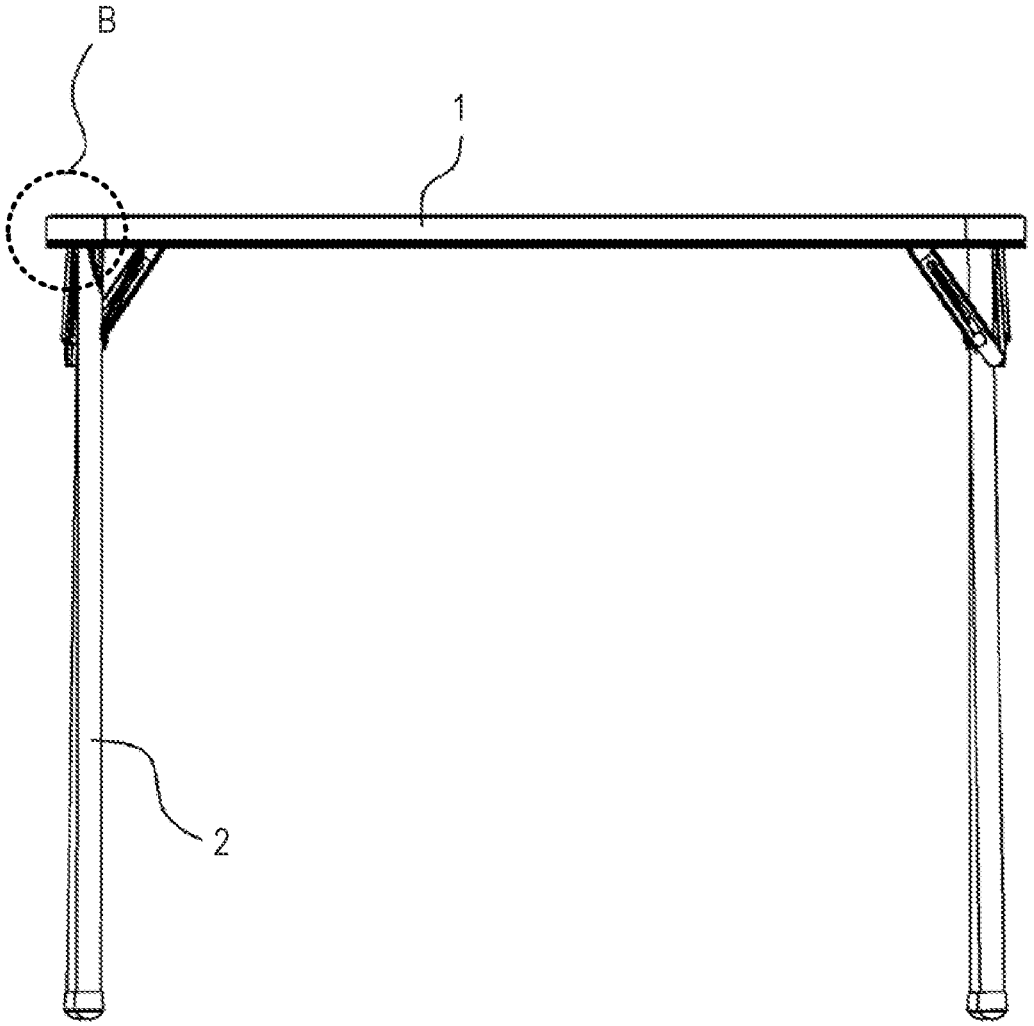
FIG. 5 illustrates a schematic diagram of a table of a third embodiment.
Figure 6:
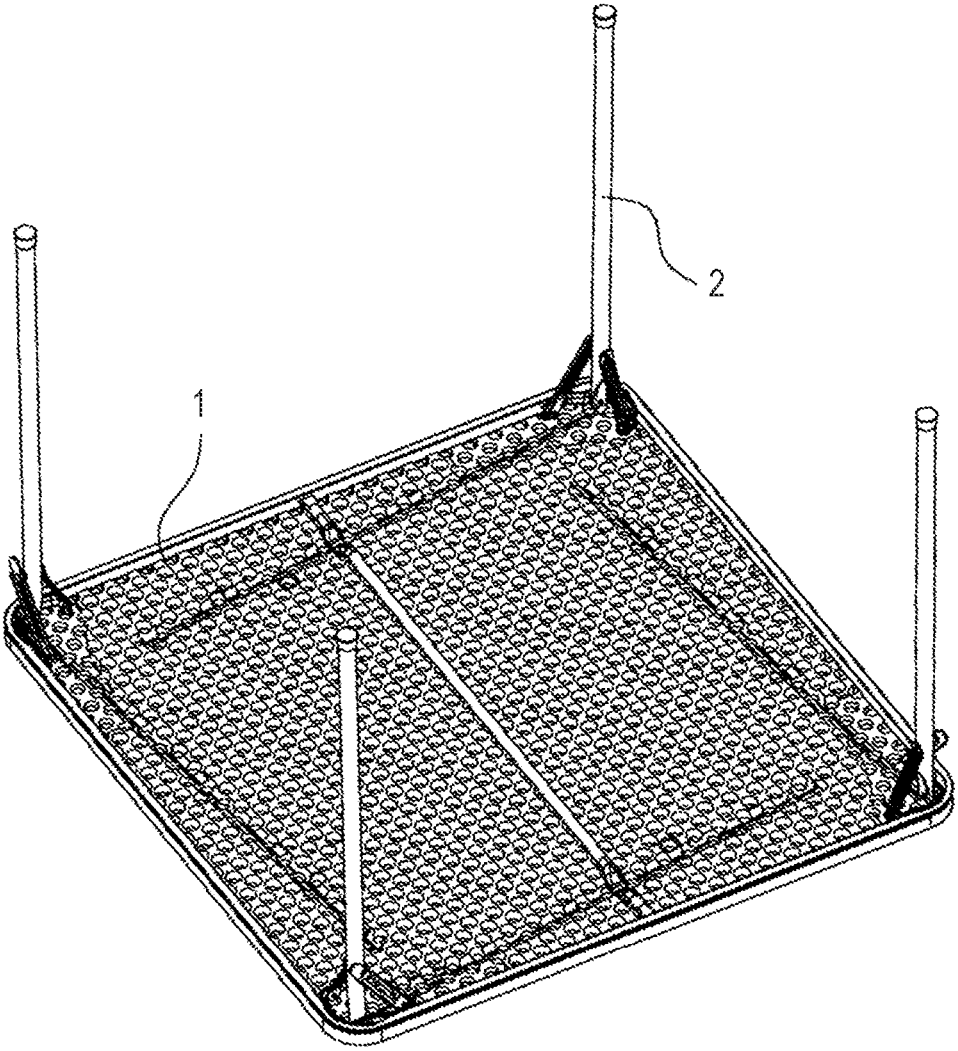
FIG. 6 illustrates a schematic diagram of the bottom portion of the table of the third embodiment.
Figure 7:
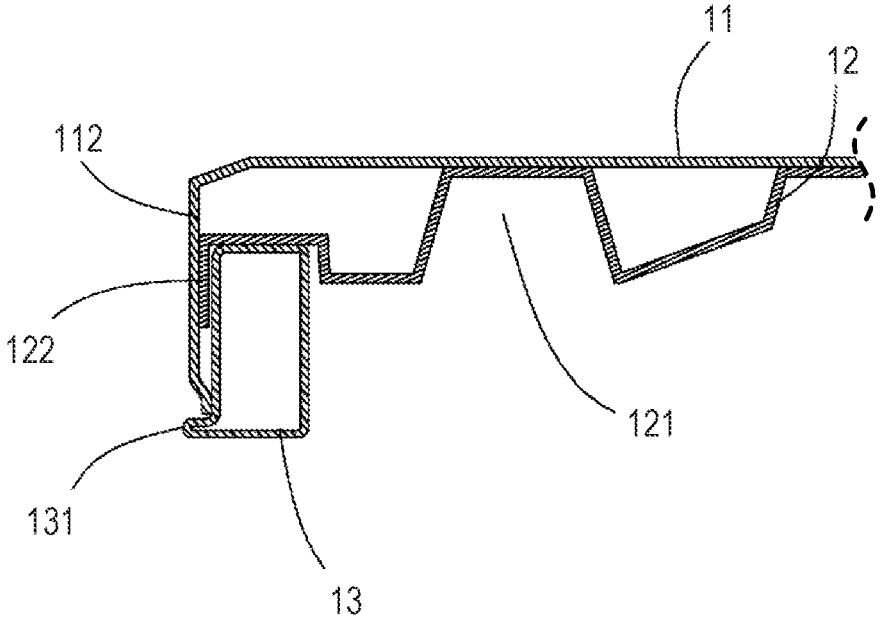
FIG. 7 illustrates an enlargement diagram of B of FIG. 5.

Referring to FIG. 5, FIG. 6 and FIG. 7, the table of this embodiment is a square table comprising a table top 1 and table legs 2. The table legs 2 are foldable and connected to the bottom portion of the table top 1. The table top 1 comprises a top plate 11 and a bottom plate 12 being stackable together. The bottom plate has projections or concave features 121. The edge of the bottom surface of the table top 1 is disposed with a metal frame 13, which supports on the bottom plate 12. The metal frame 13 is locked to the bottom plate 12. A screw 14 (not shown) passes through the metal frame 13 to lock to the bottom plate 12 from end up.

The edge of the top plate 11 is disposed with a downwardly extending top plate side 112. The edge of the bottom plate 12 is disposed with a downwardly extending bottom plate side 122. The top plate side 112 and the bottom plate side 122 are in contact and attached together. The metal frame 13 is disposed with a protruding portion 131, which is a substantially lateral straight edge at the bottom portion of the metal frame. The bottom portion of the top plate side 112 ends at the protruding portion 131 of the metal frame.

The Fourth Embodiment

Figure 8:
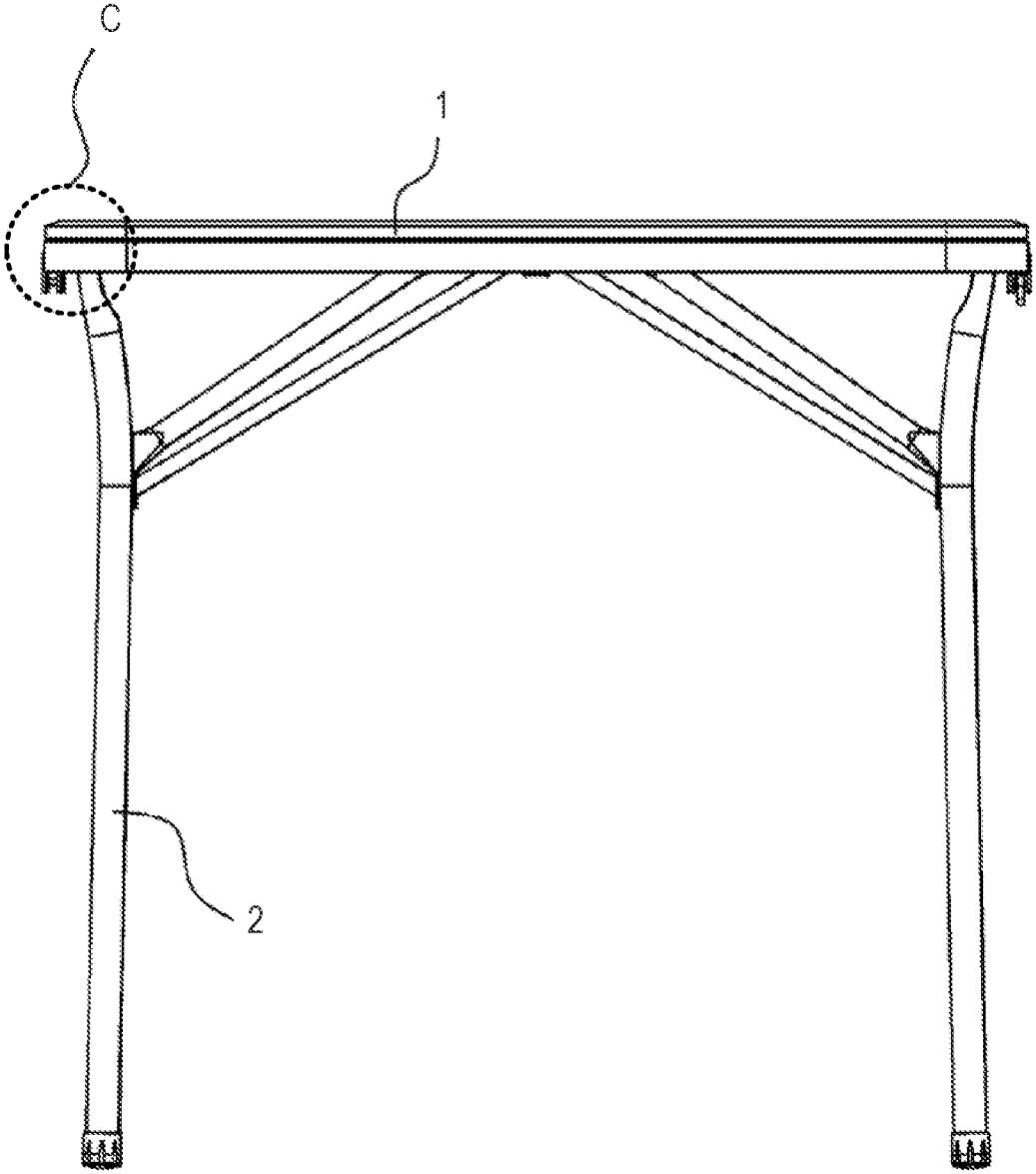
FIG. 8 illustrates a front view of a table of a fourth embodiment.
Figure 9:
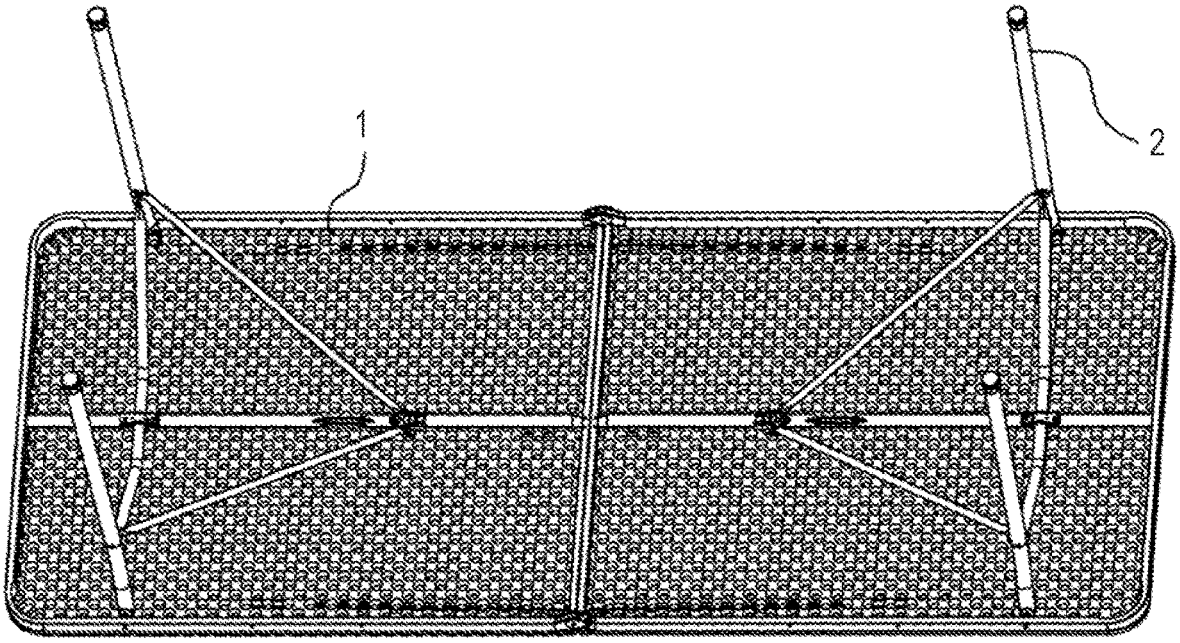
FIG. 9 illustrates a schematic diagram of the bottom portion of the fourth embodiment.
Figure 10:
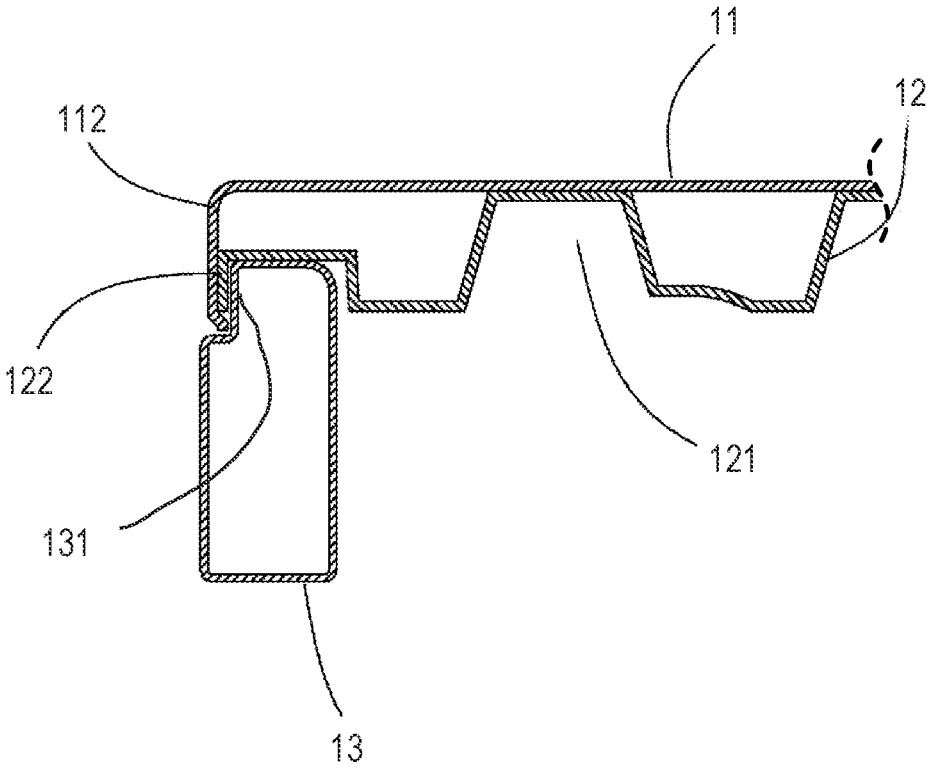
FIG. 10 illustrates an enlargement diagram of C of FIG. 8.

Referring to FIG. 8, FIG. 9 and FIG. 10, the table of this embodiment is a long table with a foldable table top, the table comprises a table top 1 and table legs 2. The table legs 2 are foldable and connected to the bottom portion of the table top 1. The table top 1 comprises a top plate 11 and a bottom plate 12 being stackable together. The bottom plate has projections or concave features 121. The edge of the bottom surface of the table top 1 is disposed with a metal frame 13, which supports on the bottom plate 12. The metal frame 13 is locked to the bottom plate 12.

The edge of the top plate 11 is disposed with a downwardly extending top plate side 112. The top plate side 112 and the bottom plate side 122 are in contact and attached together. The metal frame 13 is disposed with a protruding portion 133. The bottom portion of the top plate side 112 ends at the protruding portion 133 of the metal frame.

Although the present invention has been described with reference to the preferred embodiments thereof for carrying out the patent for invention, it is apparent to those skilled in the art that a variety of modifications and changes may be made without departing from the scope of the invention which is defined by the appended claims.

The invention claimed is:

1. Furniture comprising:

a top plate having a flat inner section having first, second, third and fourth sides;

first, second, third and fourth top plate sides at the first, second, third and fourth sides of the inner section, respectively;

a bottom plate having projections and concave features extending under the inner section of the top plate, the top plate attached to top surfaces of the projections;

first, second, third and fourth hollow frame tubes at the first, second, third and fourth sides of the top plate, respectively, each hollow frame tube having a lower portion having a first width and an upper portion in contact with the bottom plate having a second width less than the first width;

the upper portion of each hollow frame tube attached to the bottom plate;

the upper portion of the first hollow frame tube having an outer wall inwardly offset from an outer wall of the lower portion of the first hollow frame tube, providing an outward-facing recess at the top of the first hollow frame tube; and a first bottom plate side at a first side of the bottom plate, wherein a lower portion of the first top plate side and the first bottom plate side are in the outward-facing recess.

2. The furniture of claim 1 wherein the outward-facing recess is formed only by one vertical surface of the outer wall of the upper portion perpendicularly adjoining a horizontal surface of the outer wall of the upper portion.

3. The furniture of claim 1 wherein the first bottom plate side is between the first top plate side and the upper portion of the first hollow frame tube.

4. The furniture of claim 1 wherein the lower portion of the first top plate side includes an inward joggle above the outward-facing recess.

5. The furniture of claim 4 wherein the first top plate side has a lower edge vertically below the first bottom plate side.

6. The furniture of claim 3 wherein the outer wall of the first hollow frame tube is flat and the first hollow frame tube has a flat inner wall parallel to the outer wall, and a flat bottom wall joined to and perpendicular to, the inner wall and the outer wall.

7. The furniture of claim 1 wherein the upper portion of the first hollow frame tube is attached to a horizontal outer perimeter section the bottom plate.

8. The furniture of claim 1 further including one or more fasteners attaching the hollow frame tubes to the bottom plate.

9. The furniture of claim 1 wherein a lower portion of each hollow frame tube has a first width and a first length, and the upper portion of each hollow frame tube has a second width less than the first width, and a second length less than the first length.

10. The furniture of claim 1 further including a first bottom plate side on the bottom plate, wherein a lower portion of the first top plate side is parallel to and in contact with the first bottom plate side, and the first bottom plate side is in contact with and parallel to an outer wall of the upper portion of the first hollow frame tube.

11. The furniture of claim 1 wherein each hollow frame tube has a flat outer wall parallel to and offset to an outer side of one of the top plate sides.

12. The furniture of claim 1 wherein the lower portion of each hollow frame tube has a first length and the upper portion of each hollow frame tube has a second length less than the first length, providing an outward-facing recess at an upper end of the hollow frame tube, the upper portion and the lower portion each having an entirely flat outer wall;

the bottom plate overlying the upper portion of each hollow frame tube; and the upper portion of each hollow frame tube contacting a flat vertical inner surface of one of the bottom plate sides.

13. The furniture of claim 12 wherein each hollow frame tube has a width WW and height greater than the width WW, and wherein the height of each hollow frame tube is greater than a height of the bottom plate.

14. The furniture of claim 12 wherein an upper portion of a first one of the hollow frame tubes has a flat outer wall inwardly offset from a flat outer wall of the lower portion of the first hollow frame tube, a lower portion of a first one of the top plate sides and a first one of the bottom plate sides positioned alongside the outer wall of the upper portion of the first hollow frame tube.

15. The furniture of claim 14 wherein the first bottom plate side is between the first top plate side and the upper portion of the first hollow frame tube.

16. The furniture of claim 12 wherein a lower portion of each top plate side extends into a recess at the top of one of the hollow frame tubes.

17. The furniture of claim 12 wherein a lower portion of each top plate side is parallel to and in contact with one of the bottom plate sides, and each bottom plate side is in contact with and parallel to an outer wall of the upper portion of one of the hollow frame tubes, and wherein each hollow frame tube has an inner wall parallel to the outer wall, and a bottom wall joined to and perpendicular to, the inner wall and the outer wall.

18. Furniture comprising:

a top plate having a flat inner section having first, second, third and fourth sides;

first, second, third and fourth top plate sides at the first, second, third and fourth sides of the inner section, respectively;

the first, second, third and fourth top plate sides overlying first, second, third and fourth sides bottom plate sides of a bottom plate, respectively;

the bottom plate having and projections and concave features extending under the inner section of the top plate;

first, second, third and fourth hollow frame tubes at the first, second, third and fourth sides of the top plate, respectively, each hollow frame tube having a lower portion having a first width and an upper portion having a second width less than the first width;

the upper portion of the first hollow frame tube having an outer wall inwardly offset from an outer wall of the lower portion of the first hollow frame tube, providing an outward-facing recess at the top of the first hollow frame tube; and a first bottom plate side at a first side of the bottom plate, wherein a lower portion of the first top plate side and the first bottom plate side are in the outward-facing recess.

19. The furniture of claim 18 wherein a lower edge of the first top plate side extends below a lower edge of the first bottom plate side.

* * * * *